US006654571B2

(12) United States Patent
Nanataki et al.

(10) Patent No.: US 6,654,571 B2
(45) Date of Patent: Nov. 25, 2003

(54) IMAGE HEATING DEVICE WITH TEMPERATURE SENSORS PROVIDED IN SHEET PASSING PORTION AND NON-SHEET PASSING PORTION

(75) Inventors: Hideo Nanataki, Kanagawa (JP); Tetsuya Sano, Shizuoka (JP); Takao Kume, Shizuoka (JP); Katsuhito Shiratori, Shizuoka (JP); Takashi Nomura, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/931,716

(22) Filed: Aug. 20, 2001

(65) Prior Publication Data

US 2002/0044789 A1 Apr. 18, 2002

(30) Foreign Application Priority Data

Aug. 22, 2000 (JP) ..... 2000-250827

(51) Int. Cl.[7] ..... G03G 15/20
(52) U.S. Cl. ..... 399/69; 219/216
(58) Field of Search ..... 399/69, 70; 219/216

(56) References Cited

U.S. PATENT DOCUMENTS

| | | | | |
|---|---|---|---|---|
| 5,177,549 A | | 1/1993 | Ohtsuka et al. | 355/284 |
| 5,331,384 A | * | 7/1994 | Otsuka | 399/45 |
| 5,412,453 A | * | 5/1995 | Matsuo | 399/33 |
| 5,881,349 A | | 3/1999 | Nanataki et al. | 399/328 |
| 5,940,655 A | | 8/1999 | Sano et al. | 399/69 |
| 5,970,299 A | | 10/1999 | Sano et al. | 399/330 |
| 6,031,215 A | | 2/2000 | Nanataki et al. | 219/619 |
| 6,049,691 A | | 4/2000 | Abe et al. | 399/330 |
| 6,072,964 A | | 6/2000 | Abe et al. | 399/69 |
| 6,246,843 B1 | | 6/2001 | Nanataki et al. | 399/45 |

FOREIGN PATENT DOCUMENTS

| | | |
|---|---|---|
| JP | 4-296889 | 10/1992 |
| JP | 7-104608 | * 4/1995 |
| JP | 10-301435 | * 11/1998 |

* cited by examiner

*Primary Examiner*—Quana M. Grainger
(74) *Attorney, Agent, or Firm*—Fitzpatrick, Cella, Harper & Scinto

(57) ABSTRACT

An image heating device includes: a heating member having a heater that is in contact with a bearing member, which bears an image, and heats the image, a first temperature detecting member that is disposed above a surface of the heating member with a gap therebetween and detects a temperature of the heating member, a second temperature detecting member that is disposed in contact with the surface of the heating member and detects a temperature of the heating member and a controller for controlling a supply of a power to the heater on the basis of a detected output of the first and second temperature detecting members, wherein the controller controls the supply of the power to the heater on the basis of the detected output of the first temperature detecting member at the time of heating the image and controls the supply of the power to the heater on the basis of the detected output of the second temperature detecting member at a time of standby.

5 Claims, 6 Drawing Sheets

IMAGE HEATING DEVICE WITH TEMPERATURE SENSORS PROVIDED IN SHEET PASSING PORTION AND NON-SHEET PASSING PORTION

BACKGROUND OF THE INVENTION

1. Field of the Invention

The present invention relates to an image heating device that heats an image formed on a recording material which is preferably used as a fixing device of an image forming apparatus such as a copying machine or a printer.

2. Description of the Related Art

Up to now, as a heating device disposed in an image forming apparatus such as a copying machine, a printer or a facsimile machine using an electrophotographic system, there has been known an image heating fixing device that heats a toner image formed on a surface of a recording material in a direct manner or an indirect (transfer) manner by using toner (visualizing agent) made of a heating fusion resin through an appropriate image forming process means such as an electrophotographic, an electrostatic recording or a magnetic recording in an image forming portion of an image forming apparatus to heat and fix the toner image on the surface of the recording material as a permanently fixed image.

Up to now, as the image heating fixing device of the above type, there exists a roller heating device in which a recording material that bears a non-fixed toner image as a material to be heated is introduced into a pressure contact nip portion (fixing nip portion) that are a pair of rotary rollers made up of a fixing roller (heat roller) as a heat conductance rotary member which includes a heating means such as a halogen lamp therein and whose temperature is adjusted to a predetermined fixing temperature by the heating means, and a pressure roller that rotates in pressure contact with the fixing roller, and heats and pressurizes the recording material while nipping and transporting the recording material, to thereby heat and fix the non-fixed toner image on the recording material surface.

As usual, in the roller heating device, in order to keep the fixing roller to the predetermined temperature while controlling the lighting of the halogen lamp, a temperature detecting means such as a thermistor is brought in contact with the surface of the fixing roller to detect the temperature of the fixing roller surface. The temperature detecting means can be so arranged as to face a non-sheet passing region of the fixing roller (a region through which the recording material does not pass) or a sheet passing region of the fixing roller (a region through which the recording material passes).

However, the above-described conventional roller heating device suffers from the following problems in accordance with the detected position (a sheet passing region arrangement, a non-sheet passing region arrangement, or a non-image region arrangement) of the temperature detecting means on the fixing roller surface.

1) Non-sheet Passing Region Arrangement

The temperature detecting means that detects the temperature of the non-sheet passing region of the fixing roller is advantageous in that there occurs no stain caused by the abraded powder (paper dust) of the recording material per se, resulting in no occurrence of an image failure, because the temperature detecting means is abutted against the region through which no recording material passes. However, because it is necessary to estimate the temperature of the sheet passing region, it is difficult to conduct an accurate temperature control. In particular, in the case where a releasing layer or an elastic layer made of rubber or fluorine resin is disposed on the fixing roller, there is a case in which there occurs a drawback (hot offset) that a temperature difference between the non-sheet passing region and the sheet passing region becomes remarkable, and the temperature of the sheet passing region becomes high, to thereby contaminate the roller with the toner image, or a case in which there occurs a problem (fixing failure) that the temperature of the sheet passing region becomes low, thereby disenabling the fixing operation.

2) Sheet Passing Region Arrangement

The temperature detecting means that detects the temperature of the sheet passing region of the fixing roller can maintain a temperature proper for fixing even if rubber or the like is disposed on the fixing roller because the temperature detecting means detects the temperature of a portion through which the recording material passes. However, there is a case in which the strain caused by a slight amount of toner on the fixing roller surface is dammed and stored by repeating the printing operation, and the stored toner is sometimes discharged toward the fixing roller surface to cause the image strain (dropping). Also, there is a case in which the fixing roller surface is damaged by the temperature detecting means to make the image non-uniform.

In order to solve those problems, there is proposed a method in which a halogen heater having the same output is located within the pressure roller (a roller that is abutted against a surface of the recording material on the opposite side to the non-fixed toner image surface) so as to reflect the temperature of the fixing roller to control the lighting of the halogen heating at the fixing roller side by detecting the temperature of the pressure roller surface. However, because a power that can be supplied to the halogen heater is divided, there is a case in which the temperature of the fixing roller surface is deteriorated at a high speed device to cause the fixing failure during continuous usage.

In addition, there is proposed a method in which a thermopile, a thermistor or the like is made to face the fixing roller in a non-contact manner, to thereby prevent the toner strain and to measure the temperature of the sheet passing region. However, because the temperature detection precision of the non-contact thermistor is greatly affected by the temperature of the non-contact thermistor per se, very complicated algorithm and a large number of detection patterns must be prepared in order to accurately detect the wide temperature region pertaining to the fixing roller of from the room temperature to the fixing temperature at various atmospheric temperatures, and this arrangement is not put in practical use.

3) Non-image Region Arrangement (Non-image Region Within the Sheet Passing Region)

There is an advantage that the problems with the above arranging methods 1) and 2) can be reduced. However, it is difficult to detect the temperature of the sheet passing region over the entire sheet width, and it is impossible to prevent the stain such as the paper dust. Therefore, the arrangement includes the problems of both of the above arrangements, and is not a fundamental solving means.

SUMMARY OF THE INVENTION

The present invention has been made under the above circumstances, and therefore an object of the present invention is to provide an image heating device which is capable of disposing a temperature detecting element within a sheet passing region.

Another object of the present invention is to provide an image heating device in which the temperature detecting element is not stained with toner or paper dust.

Still another object of the present invention is to provide an image heating device having a non-contact type temperature detecting element and a contact type temperature detecting element.

Yet still another object of the present invention will become apparent from the following description.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

Now, a description will be given in more detail of preferred embodiments of the present invention with reference to the accompanying drawings.

First Embodiment

First, a first embodiment of the present invention will be described with reference to FIGS. 1 to 3.

Figure 1:
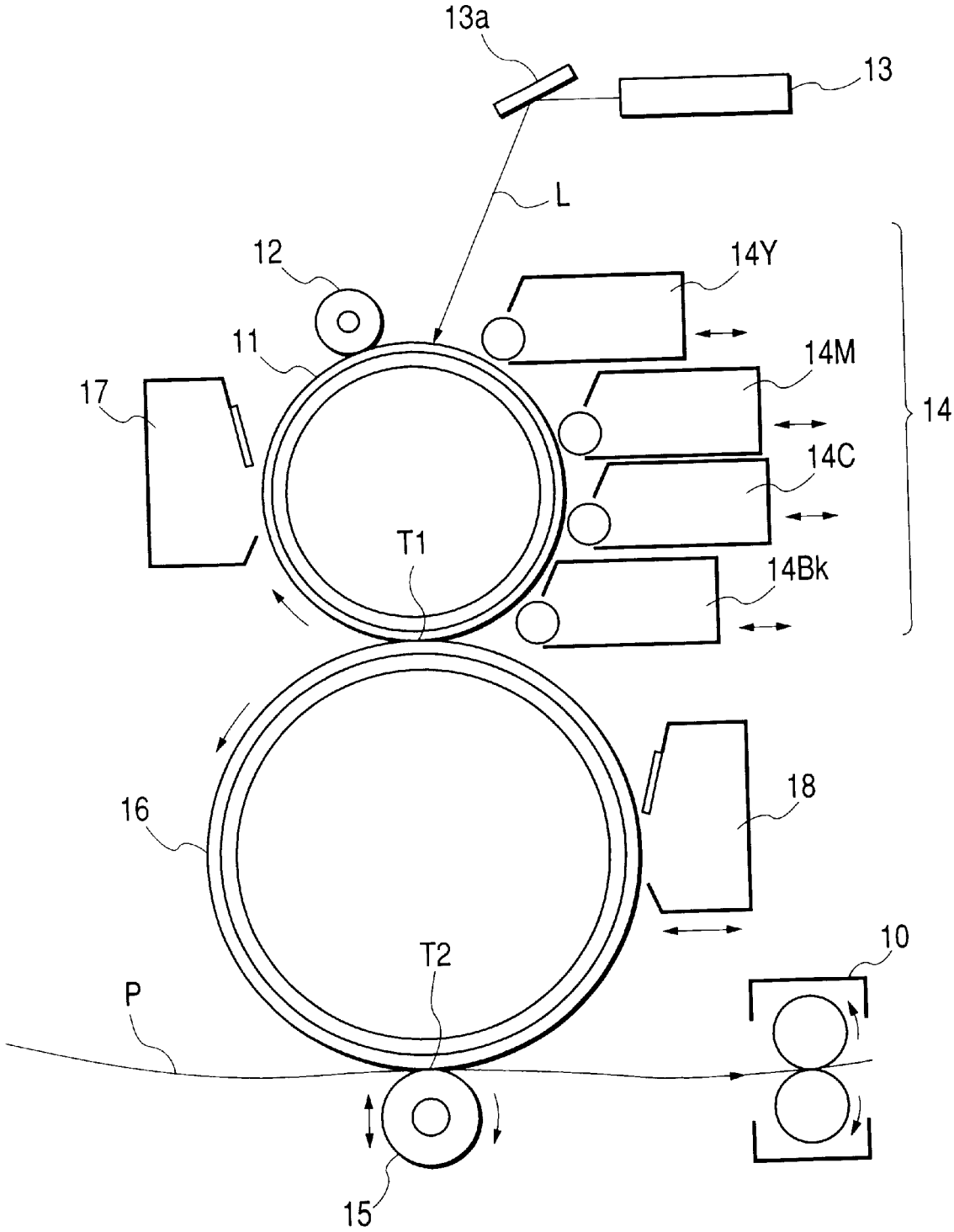
FIG. 1 is a schematic structural diagram showing an example of an image forming apparatus in accordance with a first embodiment of the present invention.

FIG. 1 is a schematic structural diagram showing an example of an image forming apparatus in accordance with the first embodiment. The image forming apparatus according to the first embodiment is directed to a full color printer using an electrophotographic process which aligns the center of the width of a recording medium in a direction perpendicular to a transporting direction with the center of a recording medium transporting path of the image forming apparatus in the above perpendicular direction.

In the image forming apparatus thus structured, an electrophotographic photosensitive drum (hereinafter referred to as "photosensitive drum") 11 which is an image bearing member formed of an organic photoconductor is driven to be rotated at a predetermined process speed (peripheral speed) in a clockwise direction indicated by an arrow. The photosensitive drum 11 is subjected to a uniform charging process with a predetermined polarity and potential by a charging device 12 such as a charging roller during a rotating process.

Then, a surface which has been subjected to the charging process is subjected to a scanning exposure process of target image information by a laser beam L outputted from a laser optical box (laser scanner) 13. The laser optical box 13 outputs a laser beam L modified (on or off) in correspondence with a time-series electric digital pixel signal of the target image information from an image signal generating device (not shown) such as a computer to expose the surface of the photosensitive drum 11 in a scanning manner, to thereby form an electrostatic latent image corresponding to the scanned and exposed target image information on a surface of the photosensitive drum 11 by the scanning exposure. The laser beam outputted from the laser optical box 13 is reflected on the exposed position of the photosensitive drum 11 by a mirror 13*a*.

In case of the full-color image formation, a first color separation component image of the target full color image, for example, a yellow component image is subjected to scanning exposure and latent image formation, and the latent image is developed as a yellow toner image by the actuation of a yellow developing device 14Y among a four-color image forming portion 14. The yellow toner image is transferred onto a surface of an intermediate transfer drum 16 at a primary transfer portion T1 which is a contact portion (or proximate portion) of the photosensitive drum 11 and the intermediate transfer drum 16. On the other hand, the surface of the photosensitive drum 11 from which the toner image has been transferred onto the surface of the intermediate transfer drum 16 has an adhered residual material such as non-transferred toner removed therefrom by a cleaner 17 so as to be cleaned.

The above process cycle of charging, scanning exposure, development, primary transfer and cleaning is sequentially executed on the respective second (for example, a magenta component image, a magenta developing device 14M is actuated), third (for example, a cyan component image, a cyan developing device 14C is actuated) and fourth (for example, a black component image, a black developing device 14BK is actuated) color separation component images, and four-color toner images consisting of a yellow toner image, a magenta toner image, a cyan toner image and a black toner image are sequentially superimposed and transferred onto the surface of the intermediate transfer drum 16, to thereby synthetically form a color image corresponding to the target full color image.

The intermediate transfer drum 16 has a medium-resistance elastic layer and a high resistance surface layer on a metal drum, and is driven to be rotated in a counterclockwise direction indicated by an arrow at substantially the same peripheral speed as that of the photosensitive drum 11 while being in contact with or in proximity to the photosensitive drum 11. A bias potential is applied to the metal drum to transfer the toner image formed at the photosensitive drum 11 side onto the intermediate transfer drum 16 surface side by the potential difference between the intermediate transfer drum 16 and the photosensitive drum 11.

The color toner images synthesized on the surface of the above intermediate transfer drum 16 is transferred onto a surface of the recording medium P fed at a predetermined timing from a sheet feeding portion (not shown) to the secondary transfer portion T2 at the secondary transfer portion T2 which is a contact nip portion of the intermediate transfer drum 16 and the transfer roller 15. The transfer roller 15 supplies charges reverse in polarity to the toner from a back surface of the recording material P to transfer a synthetic color toner image toward the recording material P side from the surface side of the intermediate transfer drum 16 collectively.

The recording material P that has passed through the secondary transfer portion T2 is separated from the surface of the intermediate transfer drum 16 and introduced into the image heating fixing device (hereinafter referred to as "fixing device") 10 which is a heating device. The unfixed toner image on the recording material P is subjected to a heating and fixing process, and the recording material P is delivered to the external delivery tray (not shown) as a color image formation material. The details of the fixing device 10 will be described later.

On the other hand, the intermediate transfer drum 16 from which the color toner image has been transferred onto the recording material P has an adhered residual material such as non-transferred toner or a paper dust removed therefrom by a cleaner 18 so as to be cleaned. The cleaner 18 is always held in the intermediate transfer drum 16 in a non-contact state, and held in the intermediate transfer drum 16 in a contact state in a process of executing the secondary transfer of the color toner image onto the recording material P from the intermediate transfer drum 16.

Also, the transfer roller 15 is also always held in the intermediate transfer drum 16 in a non-contact state and held in the intermediate transfer drum 16 in the contact state in a process of executing the secondary transfer of the color toner image onto the recording material P from the intermediate transfer drum 16.

The target image information from the above-described image signal generating device (computer) may be added with information (sheet size, sheet thickness, specific sheet information and the like) about the recording material P. The image forming apparatus according to the embodiment selects a suitable recording material P by a sheet feeding portion (not shown) on the basis of the above information and conducts the above-described sheet feeding operation, stores the information about the recording material in a storage device within the apparatus and uses the information as a parameter of the control of the fixing device 10 which will be described later.

The fixing device 10 will now be described.

Figure 2:
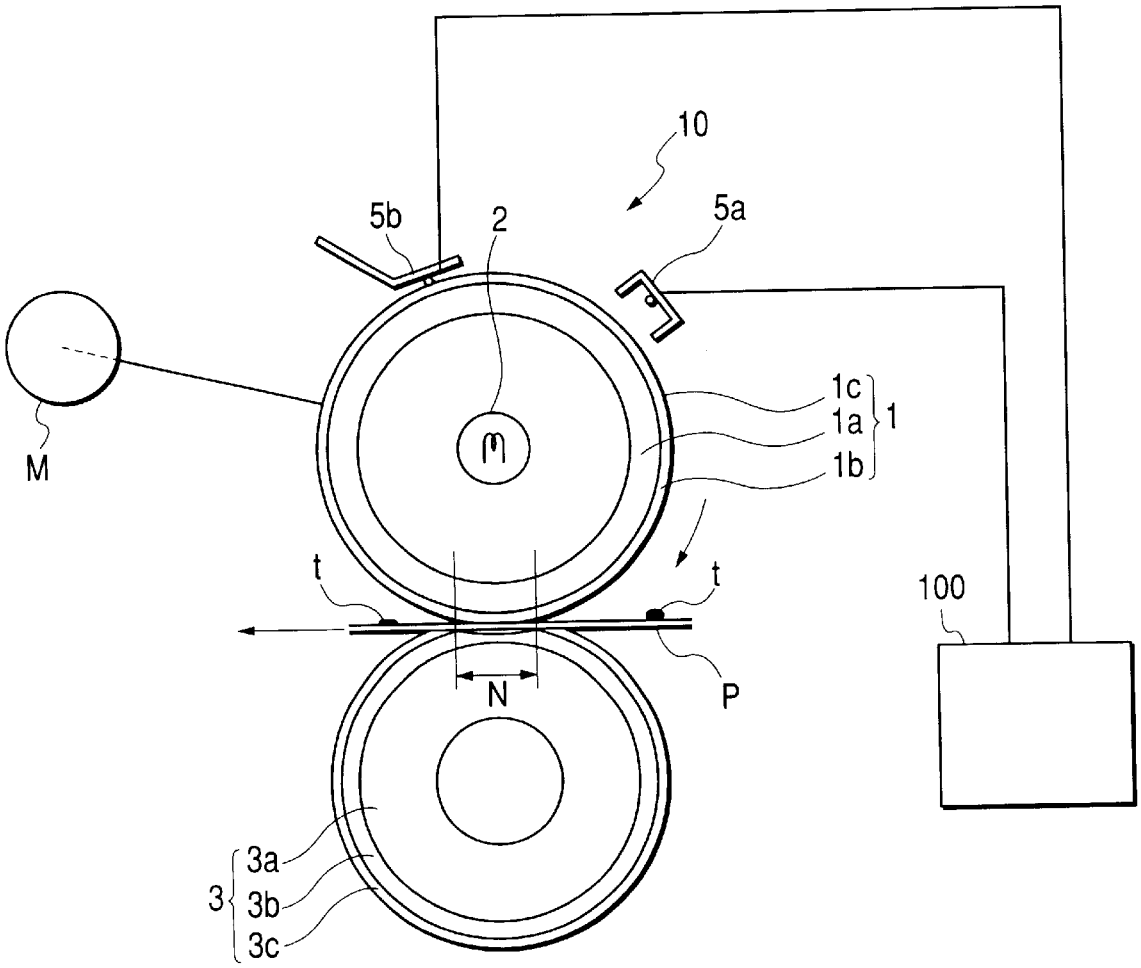
FIG. 2 is a schematic cross-sectional view showing the outline structure of a fixing device.
Figure 3:
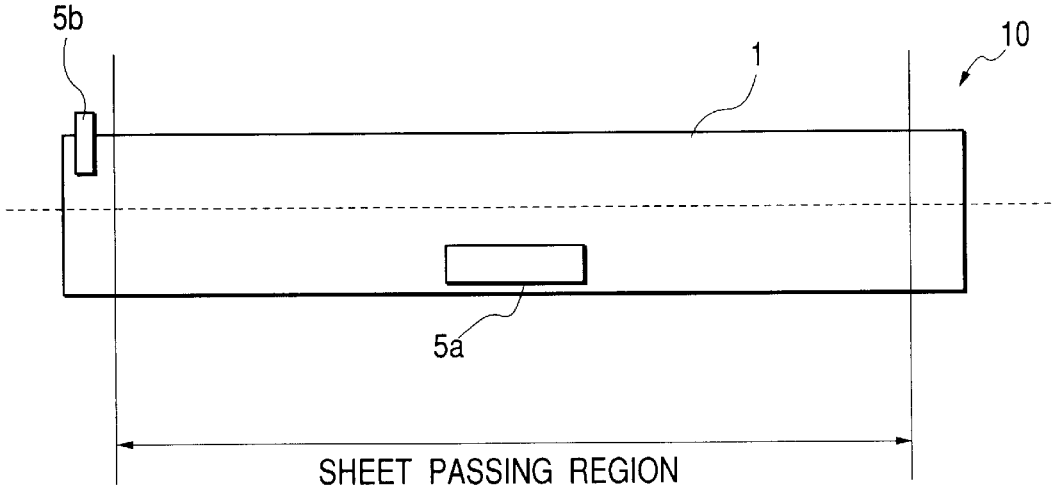
FIG. 3 is a plan view showing the fixing device.

FIG. 2 is a schematic cross-sectional view showing the outline structure of the fixing device 10, and FIG. 3 is a view of the fixing device 10 viewed from an upper side along the vertical direction.

The fixing device 10 includes a fixing roller 1 which is a heat conductance rotary member, a halogen heater 2 serving as a heating means and a pressure roller 3.

The fixing roller 1 receives the heat from the halogen heater 2 that serves as a heating element disposed in the interior of the fixing roller 1 by the heat transmission and radiation, and a peripheral surface of the fixing roller 1 which is a contact surface with the recording material is heated by the self heat conduction. Also, the fixing roller 1 is formed of an elastic roller with the outer diameter of 50 mm, which consists of an aluminum core 1*a* with the thickness of 3 mm, a silicon rubber layer 1*b* with the thickness of 2 mm which coats the outer periphery of the core 1*a*, and a PFA resin 1*c* with the thickness of 50 $\mu$m which coats the outer periphery of the silicon rubber layer 1*b*.

The pressure roller 3 is formed of an elastic roller with the outer diameter of 40 mm which is made up of a core 3*a*, a silicon rubber layer 3*b* with the thickness of 3 mm which coats the outer periphery of the core 3*a*, and a PFA resin 3*c* with the thickness of 50 $\mu$m which coats the outer periphery of the silicon rubber layer 3*b*.

The fixing roller 1 and the pressure roller 3 are brought into pressure contact with each other vertically, and then assembled in a device frame (not shown) to form a fixing nip (heating nip) portion N of a predetermined width between the fixing roller 1 and the pressure roller 3.

The fixing roller 1 is driven to be rotated in a clockwise direction indicated by an arrow shown in FIG. 2 by a drive means M, and the pressure roller 3 is driven to be rotated in a counterclockwise direction by the friction within the fixing nip portion N.

The halogen heater 2 is 700 W (at the time of 100 V) in output, and a power is supplied to the halogen heater 2 from a power supply (not shown). The power is turned on or off by a triac disposed within the power supply to turn on/off the halogen heater 2.

In the embodiment, as a temperature detecting means that detects the temperature of the surface of the fixing roller 1, a thermopile 5*a* that serves as a first temperature detecting member is disposed at a position apart from the surface of the substantially center of the recording member in the widthwise direction which is a sheet passing region of the fixing roller 1 by 5 mm in the radial direction, and an NTC element 5*b* that serves as a second temperature detecting means is abutted against the surface of the non-sheet passing region of the fixing roller 1.

A control circuit 100 that serves as a control means controls the on/off operation of the triac to adjust the surface temperature of the fixing roller 1 to a target temperature (about 180° C.) of a predetermined temperature on the basis of the detected temperatures of the thermopile 5*a* and the NTC element 5*b*.

The recording material P that bears the non-fixed toner image t is introduced into the fixing nip portion N between the fixing roller 1 and the pressure roller 3, as a result of which the recording material P is brought into close contact with the outer surface of the fixing roller 1 and passes through the fixing nip portion N together with the fixing roller 1, and the toner image t is heated by the heat transmission from the fixing roller 1 in a process of passing through the fixing nip portion N to heat and fix the toner image. The recording material P that has passed through the fixing nip portion N is separated from the outer surface of the fixing roller 1 at an outlet side of the fixing nip portion N and then fed.

The control by the control circuit 100 will now be described.

The control circuit 100 selects and calculates a detected temperature Ta by the thermopile 5*a* and a detected temperature Tb by the NTC element 5*b* to turn on/off the halogen heater 2.

That is, if it is judged that the surface temperature of the fixing roller 1 is lower than the target temperature, the halogen heater 2 is turned on whereas if it is judged the former is higher than the latter, the halogen heater 2 is turned off.

If the temperature of the fixing roller 1 is low at the time of turning on the power supply, the halogen heater 2 is continuously turned on under the above control to have the temperature of the fixing roller 1 rise rapidly (ramp-up control). Also, the control circuit 100 conducts the print control that controls the temperature to a print temperature with high accuracy in order to conduct the fixing operation and the standby control that stops the fixing roller 1 for standby in order to shift the control to the print control with no waiting period of time.

Because the thermopile 5*a* has different outputs depending on the self temperature, the NTC element is disposed in the interior of the thermopile 5*a* in order to correct the output, and the thermopile 5*a* transmits that output to the control circuit 100. It is necessary that the control circuit 100 calculates the detected temperature Ta by conducting complicated calculation from those two output values or by using a large amount of tables. In general, a calculating circuit that conducts the sequence control of the apparatus is unstable to deal with the complicated calculation or the large amount of tables, and therefore it is necessary to simplify those calculation or tables in order to put the apparatus into practical use.

In the embodiment, the NTC element 5*b* is disposed so as to be abutted against the non-sheet passing portion, and the halogen heater 2 is controlled by using the detected temperature Tb in the ramp-up period of the fixing device 10 and in the standby control or by using the detected temperature Ta of the thermopile 5*a* in the print control that fixes the recording material P. Because the table for calculating the detected temperature Ta through the above control method can be focused on a portion related to the vicinity of the print temperature (150 to 200° C.), the capacity can be made very small. Specifically, the table for obtaining the detected temperature precision of ±0.5 degree can be reduced to about 300 Kbytes to 1 Kbytes.

The table storage capacity of 1 Kbytes is ensured within the control circuit 100, and comparison and study have been conducted on the fixing device 10 and a fixing device in which the arrangement of the temperature detecting means is changed. The following four kinds of structures were compared with each other at the environmental temperature of 5 to 35° C.

Structure I: (the present embodiment) the arrangement of the thermopile in the substantially center in a non-contact manner, and the arrangement of the NTC element in the non-sheet passing region in a contact manner.

Structure II: the arrangement of the thermopile in the center in the non-contact manner.

Structure III: the arrangement of the NTC element in the center in the contact manner.

Structure IV: the arrangement of the NTC element in the non-sheet passing region in the contact manner.

The comparison was conducted on the following items.

Item I: maximum error between an actual temperature and the detected temperature in the center portion (unit: degree)

Item II: the presence/absence of the hot offset occurrence (O: no occurrence in all the environments, x: occurrence)

Item III: fixing property (O: good in all the environments, x: bad in partial environments) Item IV: image uniformity (O: no damage after 100 K sheets passed, x: damage)

The result of the comparison and study is shown in Table 1.

TABLE 1

| | Temperature error | Hot offset | Fixing property | Image uniformity |
|---|---|---|---|---|
| Structure I | 0.5 | ○ | ○ | ○ |
| Structure II | 25 | X | X | ○ |
| Structure III | 0.5 | ○ | ○ | X |
| Structure IV | 30 | X | X | ○ |

As shown in Table 1, according to the embodiment, the temperature error can be decreased to be small in all the environments even in the same storage and calculation capacity as those of the temperature control by the conventional NTC element contact. Therefore, there occurs no hot offset or no fixing failure. Also, since no member that comes in contact with the surface of the fixing roller 1 is in the sheet passing region, the image failure due to dropping and the damage of the fixing roller 1 can be prevented, thereby ensuring the image uniformity.

Second Embodiment

Subsequently, a second embodiment of the present invention will be described with reference to FIGS. 4 and 5. The same structures as those in the first embodiment are designated by identical reference numerals, and their description will be omitted.

Figure 4:
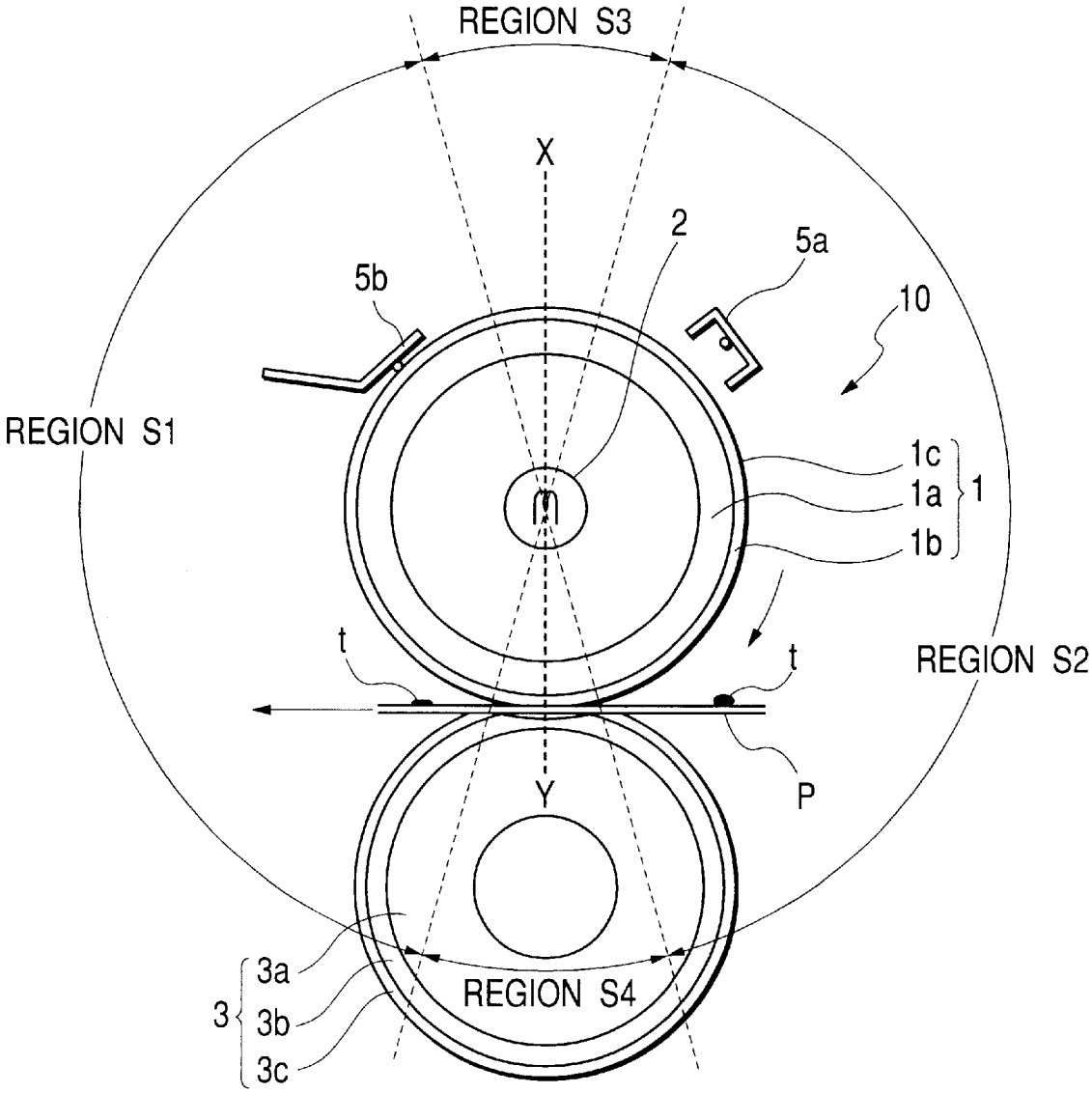
FIG. 4 is a schematic cross-sectional view showing the outline structure of a heating device in accordance with a second embodiment of the present invention.

FIG. 4 is a schematic cross-sectional view showing the outline structure of a heating device in accordance with a second embodiment of the present invention.

The heating device according to the second embodiment is identical with the above-mentioned heating devices shown in FIGS. 1 to 3 except that the arrangement of the temperature detecting means shown in FIG. 4 is different.

In the second embodiment, a thermopile 5*a* that serves as a first temperature detecting member which is disposed in the substantially center of the fixing roller 1 in the longitudinal direction in a non-contact manner and an NTC element 5*b* that serves as a second temperature detecting member which is disposed in contact with the non-sheet passing region are disposed on a portion where the surface temperature of the fixing roller 1 is identical as the positional relationship in the rotating direction of the fixing roller 1.

Figure 5:
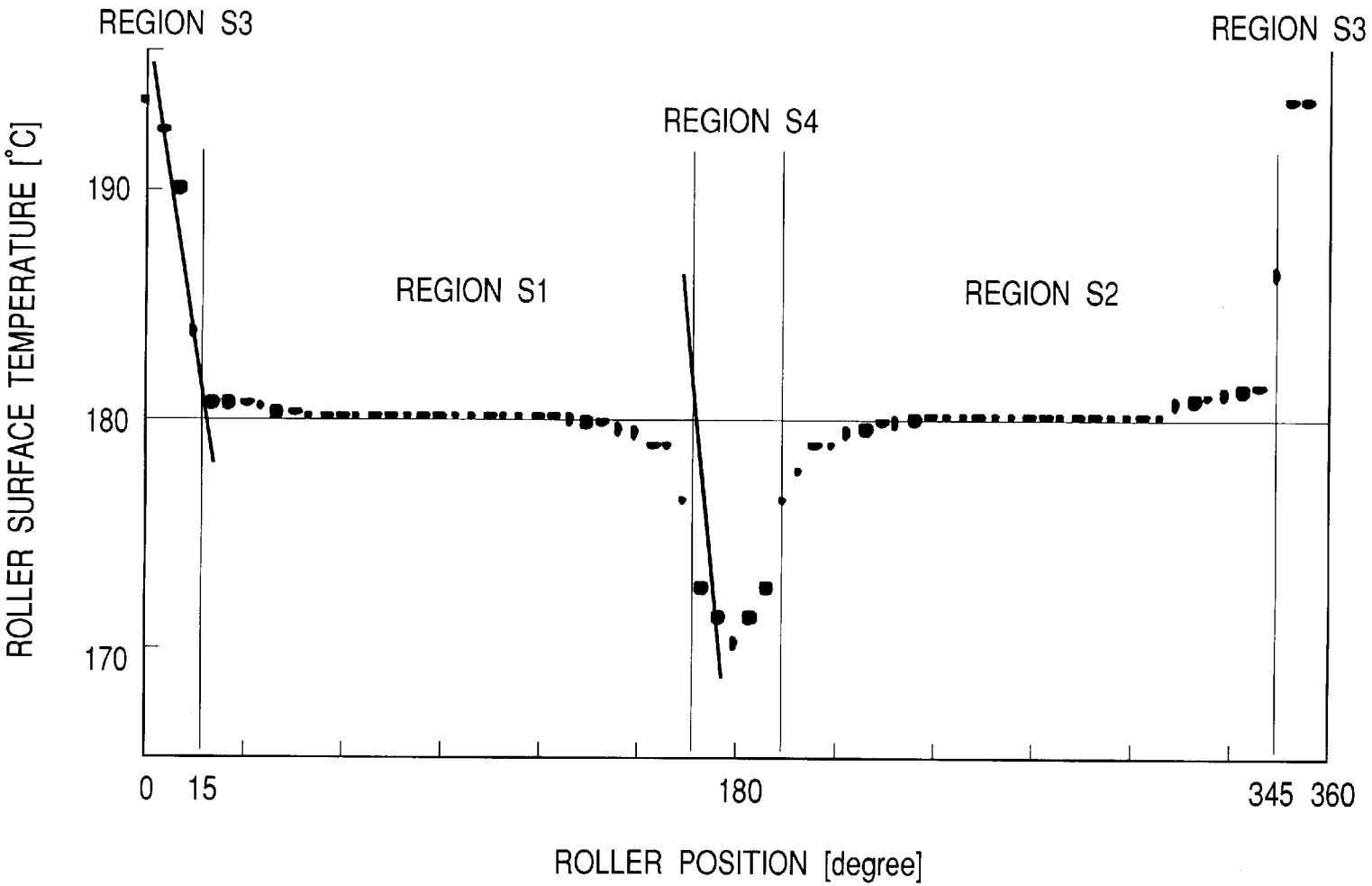
FIG. 5 is a graph showing a temperature distribution when a surface temperature at the time of stopping a fixing roller is measured from an upper cross line of a vertical plane XY and the fixing roller in FIG. 4 in a counterclockwise direction.

FIG. 5 is a graph showing a distribution when a surface temperature at the time of stopping the fixing roller 1 is measured from an upper cross line of a vertical plane XY and the fixing roller 1 in FIG. 4 in a counterclockwise direction.

As is apparent from FIG. 5, the surface temperature of the fixing roller 1 becomes uneven due to the convection of the atmosphere in a range of 15 degrees on both sides of the vicinity of the vertical plane XY. The region can be roughly classified into the regions S1 and S2 of the peripheral surface of the side portion indicating the surface temperature that represents the temperature of the fixing roller 1, a region S3 of the peripheral surface of the upper portion indicating a temperature higher than the temperature of the regions S1 and S2, and a region S4 of the peripheral surface of the lower portion indicating the surface temperature lower than the temperature of the regions S1 and S2.

In the embodiment, the thermopile 5*a* and the NTC element 5*b* are disposed in the regions S2 and S1 which are the peripheral surfaces of the side portion, respectively, except for the above uneven portion so that the temperature difference between the thermopile 5*a* and the NTC element 5*b* is eliminated.

According to the embodiment, in the case where the printing operation starts from the ramp-up control, or in the case where a changeover between the thermopile 5*a* and the NTC element 5*b* is implemented when the print control is shifted to the standby state, the difference in the detected temperature between the thermopile 5*a* and the NTC element 5*b* is decreased to be minimum so that the surface temperature of the fixing roller 1 can be stably maintained.

Up to now, in the case where the NTC element 5*b* is disposed in the region S3 and the thermopile 5*a* is disposed in the region S1, a difference of 10 degree or more occurs in the detected temperatures of the thermopile 5*a* and the NTC element 5*b* in the standby control. If the intermittent printing operation is repeatedly conducted in the above circumstance, because a detected temperature jump occurs at the time of changing over the temperature measuring means, and the control of the halogen heater 2 becomes unstable, the uneven temperature of about 15 degree may occur in the surface temperature of the fixing roller 1 due to overshoot or undershoot.

In the embodiment, the above uneven temperature can be decreased within about 5 degree, thereby being capable of obtaining the excellent fixing image.

Third Embodiment

Subsequently, a third embodiment of the present invention will be described with reference to FIG. 6. The same structures as those in the first embodiment are designated by identical reference numerals, and their description will be omitted.

Figure 6:
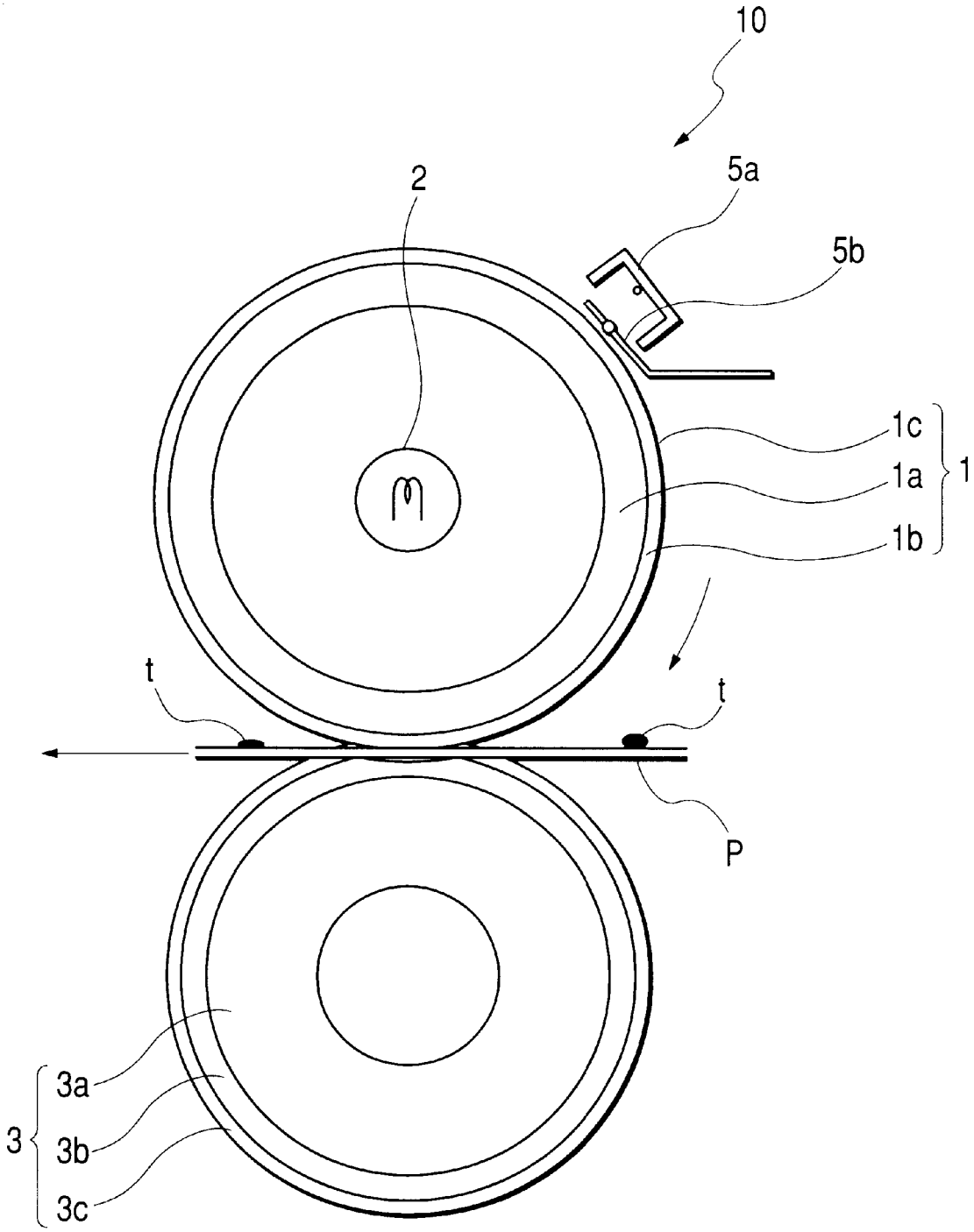
FIG. 6 is a schematic cross-sectional view showing the outline structure of a heating device in accordance with a third embodiment of the present invention.

FIG. 6 is a schematic cross-sectional view showing the outline structure of a heating device in accordance with a third embodiment of the present invention.

The heating device according to the third embodiment is identical with the above-mentioned heating devices shown in FIGS. 1 to 3 except that the arrangement of the temperature detecting means shown in FIG. 6 is different.

In the third embodiment, a thermopile 5*a* that serves as a first temperature detecting member which is disposed in the substantially center of the fixing roller 1 in the longitudinal direction in a non-contact manner and an NTC element 5*b* that serves as a second temperature detecting member which is disposed in contact with the non-sheet passing region are disposed on substantially the same generatrix of the fixing roller 1 as the positional relationship in the rotating direction of the fixing roller 1.

According to the third embodiment, when the fixing roller 1 rotates, because portions where the thermopile 5*a* and the NTC element 5*b* detect the temperature, respectively, are in the same phase, a difference of the temperatures detected by the thermopile 5*a* and the NTC element 5*b* can be further reduced, and the uneven temperature of the fixing roller 1 can be advantageously controlled within about 3 degree.

In the first to third embodiments, the first temperature detecting member may be formed of an inexpensive NTC element.

Also, in the second embodiment, the positions where the non-contact temperature measuring means and the contact temperature measuring means are disposed may be in the vicinity of the vertical plane XY.

In addition, in the first to third embodiments, a heater may be contained in the pressure roller.

As was described above, according to the present invention, because the temperature of the heating roller surface within the sheet passing region is detected in the non-contact state, the temperature control high in stain resistance, durable and high in precision is conducted.

Also, the temperature control based on the output of the temperature detecting element disposed in a non-contact manner conducts substantially only the constant temperature adjustment at the fixing temperature during the fixing operation, and the amount of table for controlling the temperature is very small.

The above description was given of the embodiments of the present invention, but the present invention is not limited to those embodiments, and any modifications can be made within the technical concept of the present invention.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image heating device, comprising:

a heating member having a heater that is in contact with a recording material, which bears an image, and heats the image;

a first temperature detecting member that is disposed above a surface of said heating member with a gap therebetween and detects a temperature of said heating member;

a second temperature detecting member that is disposed in contact with the surface of said heating member and detects a temperature of said heating member; and control means for controlling a supply of a power to said heater based on a detected temperature of said first temperature detecting member and a detected temperature of said second temperature detecting member, said control means having a table for calculating the detected temperature of said first temperature detecting member based on an output of said first temperature detecting member, wherein said control means controls the supply of the power to said heater so that the detected temperature of said first temperature detecting member is maintained at a target temperature when a temperature of the surface of said heating member is within a predetermined temperature range, and said control means controls the supply of the power to said heater so that the detected temperature of said second temperature detecting member is maintained at the target temperature when the temperature of the surface of said heating member is out of the predetermined temperature range.

2. An image heating device according to claim 1, wherein said first temperature detecting member is disposed within a contact region in which said heating member and the bearing member are in contact with each other, and said second temperature detecting member is disposed out of the contact region.

3. An image heating device according to claim 1, wherein said control means controls the supply of the power to said heater based on the detected temperature of said second temperature detecting member in a ramp-up period.

4. An image heating device according to claim 1, wherein said heating member is formed of a rotary member, and said first and second temperature detecting members are disposed at substantially the same positions in a rotating direction of said rotary member.

5. An image heating device according to claim 1, wherein said image heating device fixes a toner image on the bearing member.

* * * * *

UNITED STATES PATENT AND TRADEMARK OFFICE

CERTIFICATE OF CORRECTION

PATENT NO. : 6,654,571 B2
DATED : November 25, 2003
INVENTOR(S) : Hideo Nanataki et al.

It is certified that error appears in the above-identified patent and that said Letters Patent is hereby corrected as shown below:

Column 2,
Line 20, “strain” should read -- stain --.

Signed and Sealed this

First Day of June, 2004

JON W. DUDAS
*Acting Director of the United States Patent and Trademark Office*